US007575483B1

(12) United States Patent
Zhang

(10) Patent No.: US 7,575,483 B1
(45) Date of Patent: Aug. 18, 2009

(54) ELECTRICAL CONNECTOR HAVING SUBSTRATE HAVING CONDUCTIVE TRACE TO BALANCE ELECTRICAL COUPLINGS AMONG TERMINALS

(75) Inventor: Hong-Bo Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,581

(22) Filed: Jun. 27, 2008

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS 5,700,167 A * 12/1997 Pharney et al. ..... 439/941
6,023,200 A * 2/2000 Rhee ..... 439/941
6,447,341 B1 * 9/2002 Hyland ..... 439/941
6,488,544 B1 * 12/2002 Hyland ..... 439/941
6,506,080 B2 1/2003 Hyland
7,112,100 B2 * 9/2006 Ishikawa et al. ..... 439/941

* cited by examiner

*Primary Examiner*—Tho D Ta
(74) *Attorney, Agent, or Firm*—Wei Te Chung

(57) ABSTRACT

An electrical connector (100) includes an insulative housing (20) and a number of terminal groups (40) mounted in the insulative housing. Each terminal group includes a number of terminals (80), a substrate (60) having a first face (61) and a second face (62). The first face is formed with a fourth and a fifth conductive traces (615, 616). The second face (62) is formed with a first and a second conductive traces (621, 622) extending in parallel fashion and interconnected together and respectively aligned with the fourth and the fifth conductive traces. The terminals electrically connect with the conductive traces to establish a desired coupling effect.

15 Claims, 8 Drawing Sheets

ELECTRICAL CONNECTOR HAVING SUBSTRATE HAVING CONDUCTIVE TRACE TO BALANCE ELECTRICAL COUPLINGS AMONG TERMINALS

BACKGROUND OF THE INVENTION

1. Field of the Invention

The present invention relates to an electrical connector, and particularly to a modular jack connector having a substrate provided with a plurality of conductive traces adapted to balance electrical couplings among terminals.

2. Description of Related Art

To comply with a high-speed trend of date transmission, electrical devices are required to have better performance. Performance requirements have significantly increased to a level identified by industry standards as Category 5. The Telecommunications Industry Association (TIA) in corporation with the Electronic Industries Association (EIA) has developed a proposed standard for Category 5 components, where the transmission requirements of such components are characterized up to 100 MHz and the Near-End Cross-Talk Loss should be less than −40 dB.

A conventional RJ modular connector is described in U.S. Pat. No. 6,506,080 issued on Jan. 14, 2003. The RJ modular connector comprises a housing, defining a terminal insert receiving space. A terminal insert is received in the terminal insert receiving space and includes a substrate having a plurality of conductive traces on one surface of the substrate, and a plurality of terminals attached to an opposite surface of the substrate. One trace is aligned with a selected terminal and is electrically connected to another selected terminal to thereby establish an electrical coupling between the two selected terminals.

While the above-mentioned one conductive trace could establish electrical couplings with other terminals, balance of electrical influence among other terminals need be further considered in order to improve anti-crosstalk performance.

Hence, an improved electrical connector is required to overcome the above-mentioned disadvantages of the related art.

SUMMARY OF THE INVENTION

A primary object of the present invention is to provide an electrical connector satisfying Category 5 and having better anti-crosstalk performance.

To achieve the aforementioned object, an electrical connector comprises an insulative housing and a plurality of terminal groups mounted in the insulative housing. Each terminal group comprises a substrate having a first face and an opposite second face, and a number of terminals attached to the first face of the substrate. The second face of the substrate is formed with a first conductive trace and a second conductive trace extending in parallel fashion and interconnected together for electrically connecting with a specific terminal. The first face has a fourth conductive trace electrically connecting with a selected terminal and aligned with the first conductive trace. The first face has a fifth conductive trace electrically connecting with a definite terminal and aligned with the second conductive trace.

The first and the second conductive traces interconnected in parallel fashion would establish better electrical couplings among the selected terminal, the definite terminal and the specific terminal. Electrical influences to the selected terminal, the definite terminal created by the specific terminal can be better balanced to help improve anti-crosstalk performance.

Other objects, advantages and novel features of the invention will become more apparent from the following detailed description of a preferred embodiment when taken in conjunction with the accompanying drawings.

DETAILED DESCRIPTION OF THE INVENTION

Figure 1:
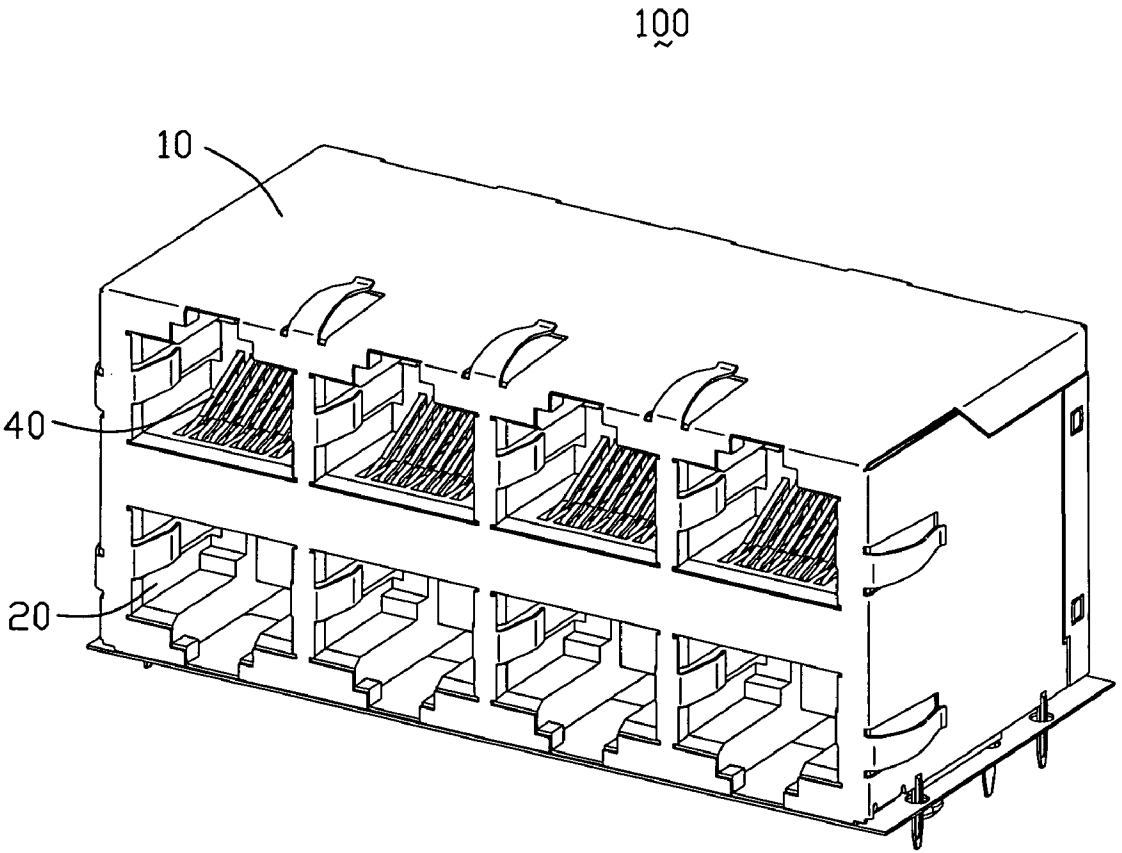
FIG. 1 is an assembled perspective view of an electrical connector in accordance with the present invention.
Figure 2:
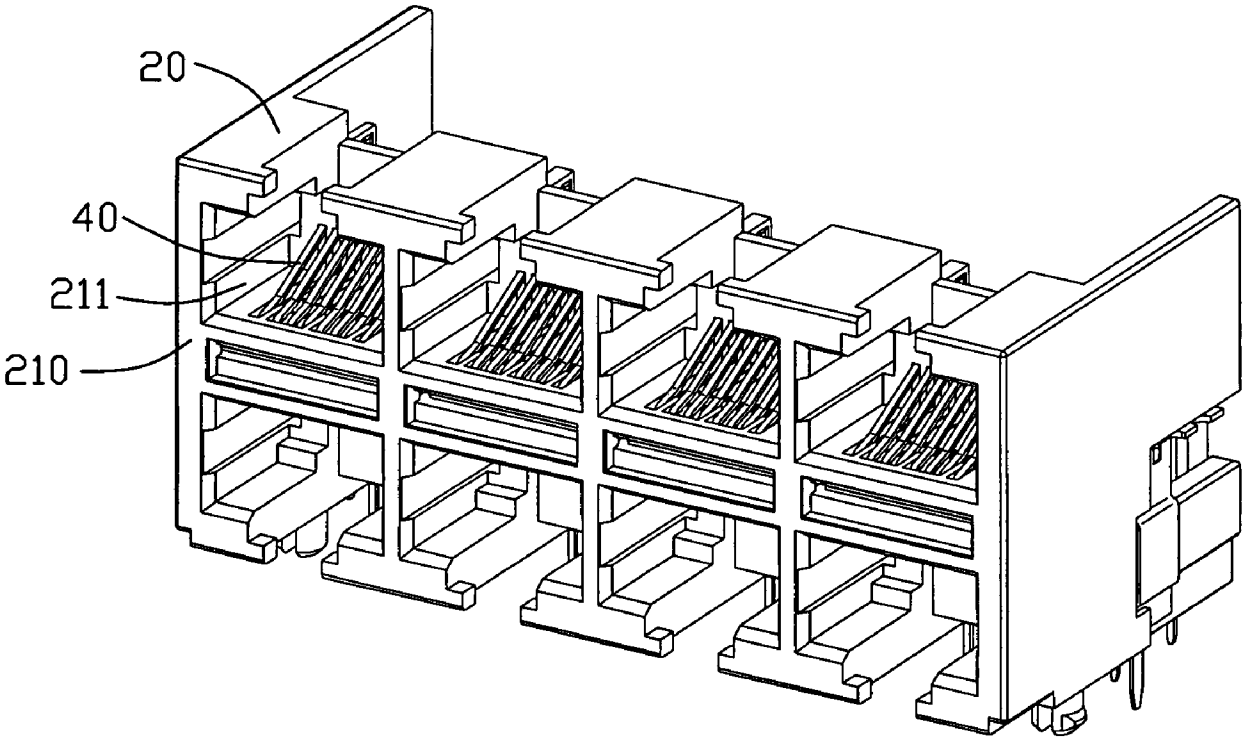
FIG. 2 is a perspective view of the electrical connector as shown in FIG. 1, with a shielding shell being removed.
Figure 3:
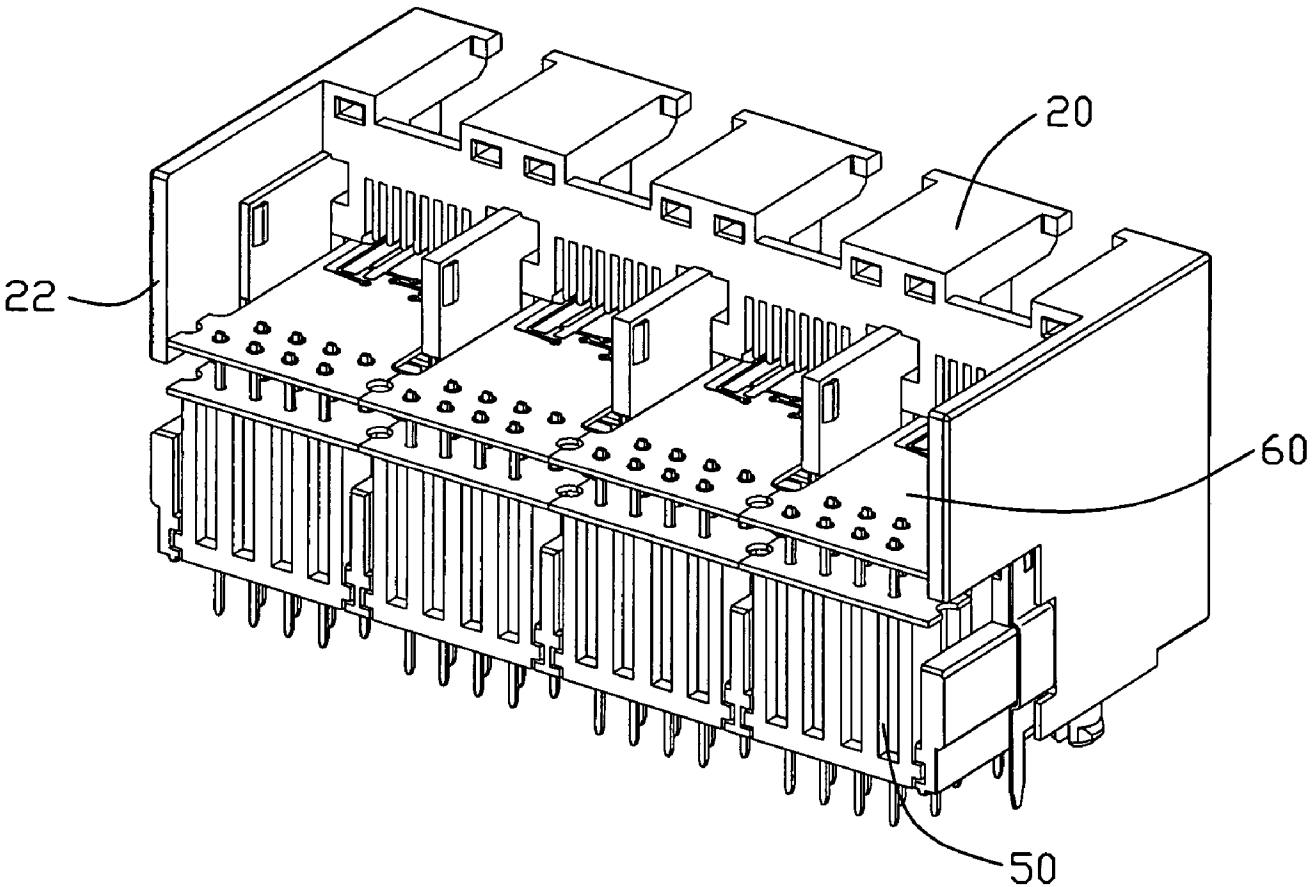
FIG. 3 is a perspective view of the electrical connector as shown in FIG. 2, taken from another aspect.
Figure 4:
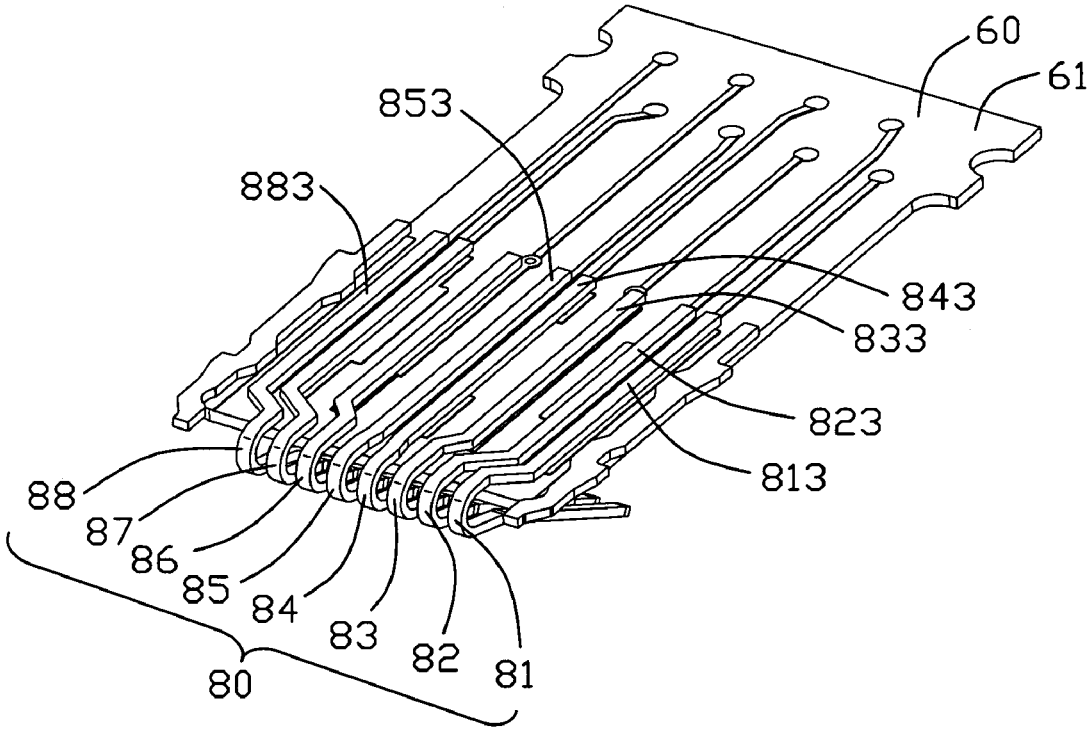
FIG. 4 is a perspective view of a substrate to which a plurality of terminals are assembled.
Figure 5:
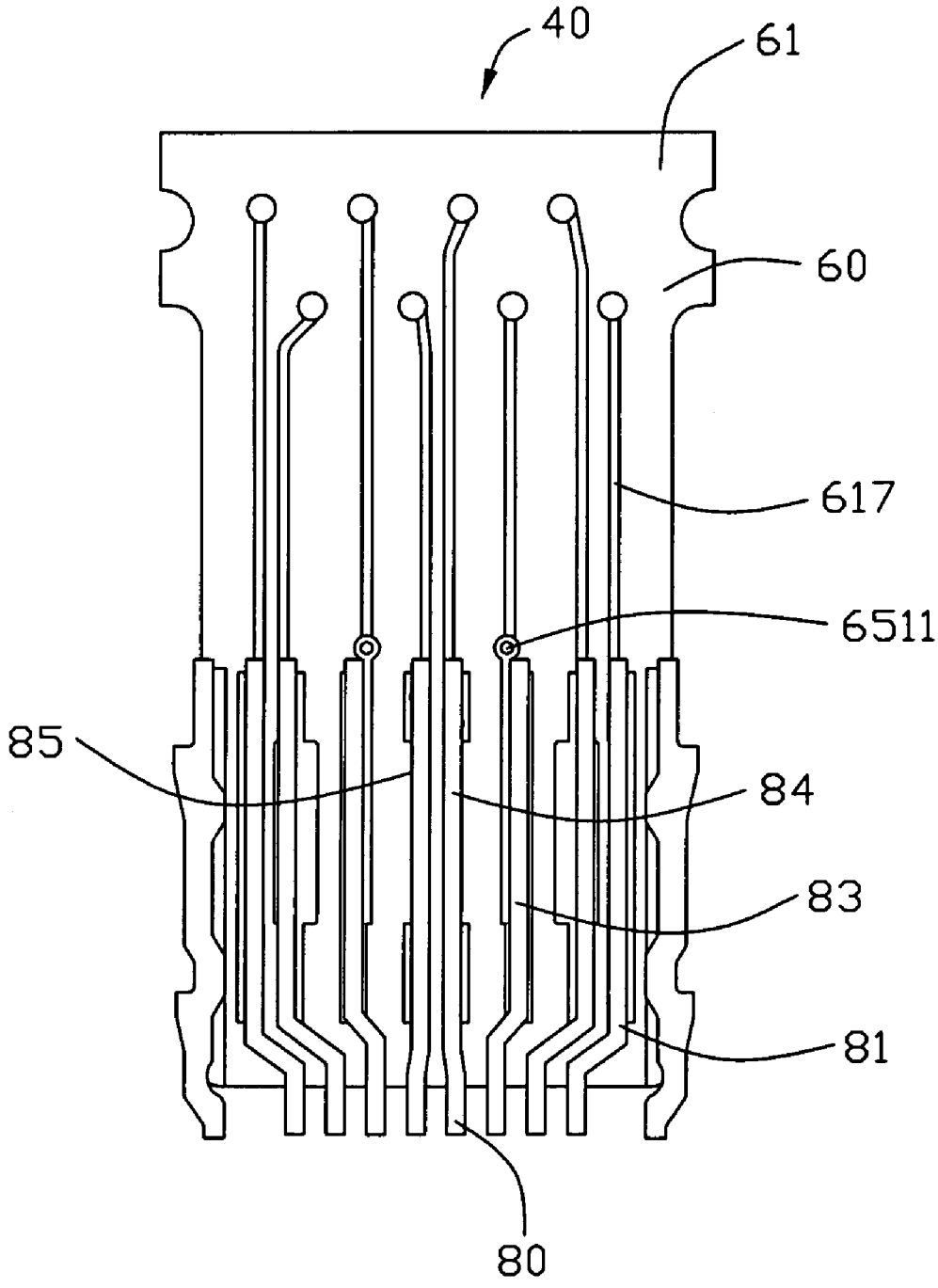
FIG. 5 is a top view of the substrate to which the terminals are assembled, showing the terminals and a first face of the substrate.

Reference will now be made to the drawing figures to describe the present invention in detail. Referring to FIGS. 1-3, an electrical connector 100 in accordance with the preferred embodiment of the present invention comprises an insulative housing 20, a shielding shell 10 attached to an outer surface of the insulative housing 20, a plurality of terminal groups 40 and a plurality of conductor groups 50.

The insulative housing 10 is substantially rectangular, having a front portion 210, a rear portion 22, and eight ports symmetrically arranged in two upper and lower rows. Each port has an opening 211 defined on the front portion 210 for mating with a mating connector (not shown).

Referring to FIGS. 4-8, each terminal group 40 comprises a substrate 60 having a first face 61 and a second face 62, and eight terminals 80 mounted on the substrate 60. The terminals 80 consist of first through eighth terminals 81-88 substantially parallel to each other and attached to the first face 61 in sequence, wherein adjacent first and the second terminals 81, 82 have substantially same shapes mutually cooperating to deliver signals. Mutual cooperation of delivering signals is also performed by one pair of the separated third and sixth terminals 83, 86, another pair of adjacent fourth and fifth terminals 84, 85 disposed in a middle portion of the substrate 60, and another pair of adjacent seventh and the eighth terminals 87, 88. The first through fourth terminals 81-84 are substantially symmetrical to the first through eighth terminals 85-88. Each terminal 81-88 has a contact portion (not labeled) and a body portion 813-883 fixed on the first face 61 of the substrate 60.

The substrate 60 is formed with a plurality of circuit traces, e.g. traces 614-616, 65, 623, etc., electrically connecting to the body portions 813-883 of the terminals 81-88. Specifically, the circuit traces include a pair of first conductive traces 621, a pair of second conductive traces 622 and a pair of third conductive traces 623 arranged on the second face 62 in parallel fashion, and a pair of fourth conductive traces 614, a pair of fifth conductive traces 615 and a pair of sixth conductive traces 616 provided on the first face 61 in parallel fashion. The conductive traces 621-623, 614-616 are respectively formed as a substantially rectangular shape and parallel to an extending direction of the body portions 813-883 of the terminals 81-88. As for the first, the second, the third conductive traces 621, 622, 623, the first conductive trace 621 is disposed in an inner portion of the second face 62 and has a smallest area, the second conductive trace 622 is disposed between the first and the third conductive traces 621, 623 and has a largest area. As for the fourth, the fifth, the sixth conductive traces 614, 615, 616, the sixth conductive trace 616 is disposed in an outer portion of the first face 61 and has a smallest area, the fifth conductive trace 615 is disposed between the fourth and the sixth conductive traces 614, 616 and has a largest area.

The third conductive trace 623 is formed with a pair of first connection portions 651 each having a first connection point or via 6511 extending from the second face 62 to the first face 61. The first and the second conductive traces 621, 622 are connected at ends thereof and are provided with a common second connection portion 652 connecting with one end thereof and a common third connection portion 654 connecting with another end thereof. The second and the third connection portions 652, 654 extend inwardly to a location approximately corresponding to that of the body portion 853 of the fifth terminal 85 and are respectively provided with a second and a third connection points or vias 6521, 6541 extending through the substrate 60 from the second face 62 to the first face 61.

The first body portion 813 of the first terminal 81 is generally aligned with both the third, the sixth conductive traces 623, 616 and is electrically connected to the sixth conductive trace 616. The second body portion 823 of the second terminal 82 is aligned with the second, the fifth conductive traces 622, 615 and is electrically connected to the fifth conductive trace 615. The third body portion 833 of the third terminal 83 is aligned with the first, the fourth conductive traces 621, 614 and is electrically connected to the fourth conductive trace 614. The third body portion 833 of the third terminal 83 contacts with the first connection point 6511 to thereby also electrically connect with the third conductive trace 623 via the first connection portions 651. The fifth body portion 853 of the fifth terminal 85 in contact with the second and the third connection points 6521, 6541 is electrically connected to the first, the second conductive traces 621, 622 by the second and the third connection portions 652, 654. The other four terminals 84, 86, 87, 88 are arranged correspondingly to the four terminals 85, 83, 82, 81, respectively, and therefore have same electrical connections. The first face 61 of the substrate 6 has a plurality of lead portions 617 for connecting the terminals 80 to a plurality of soldering holes 601 or vias defined on the substrate 60.

Figure 6:
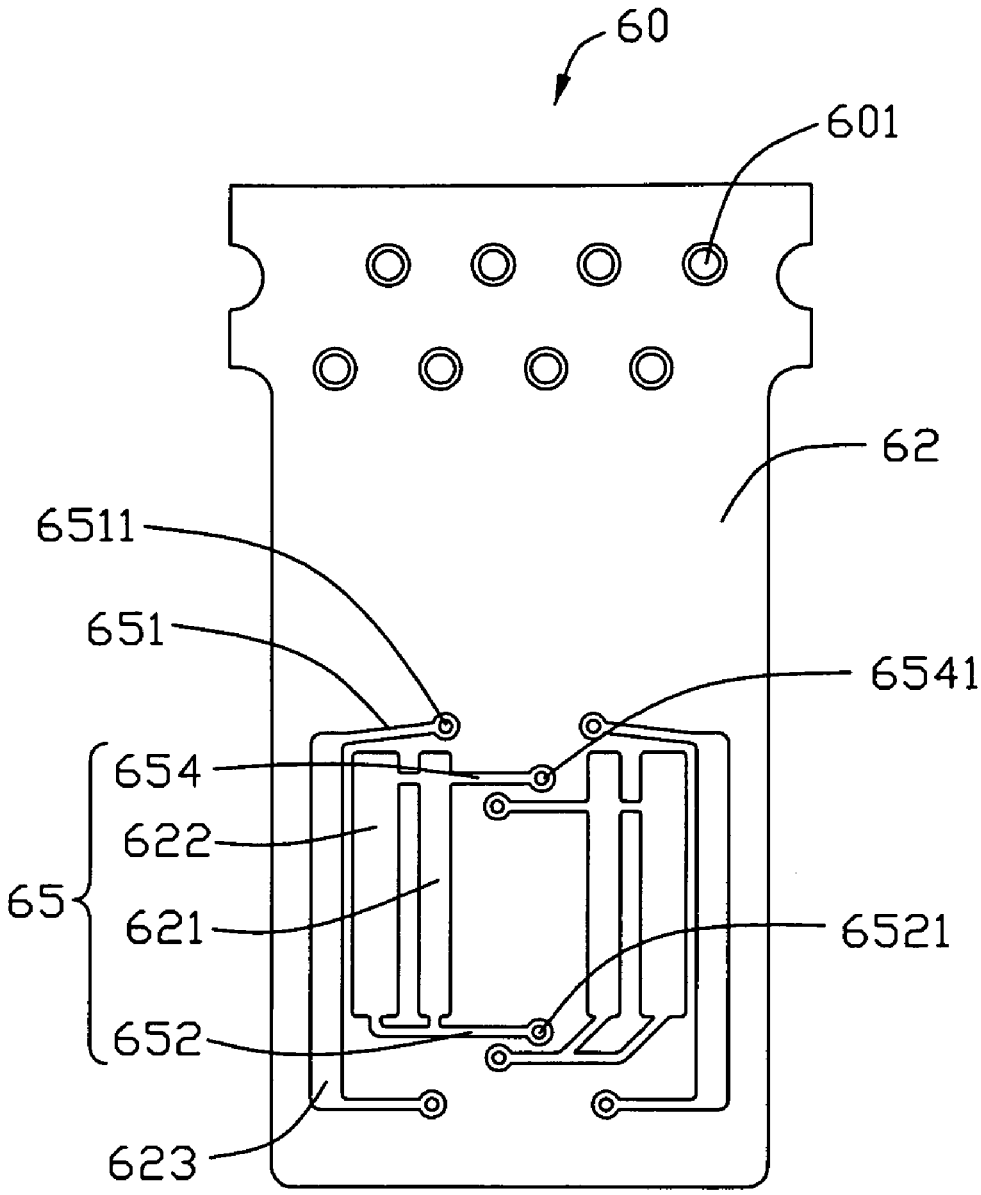
FIG. 6 is a bottom view of the substrate, with the terminals being removed, showing a second face of the substrate.
Figure 7:
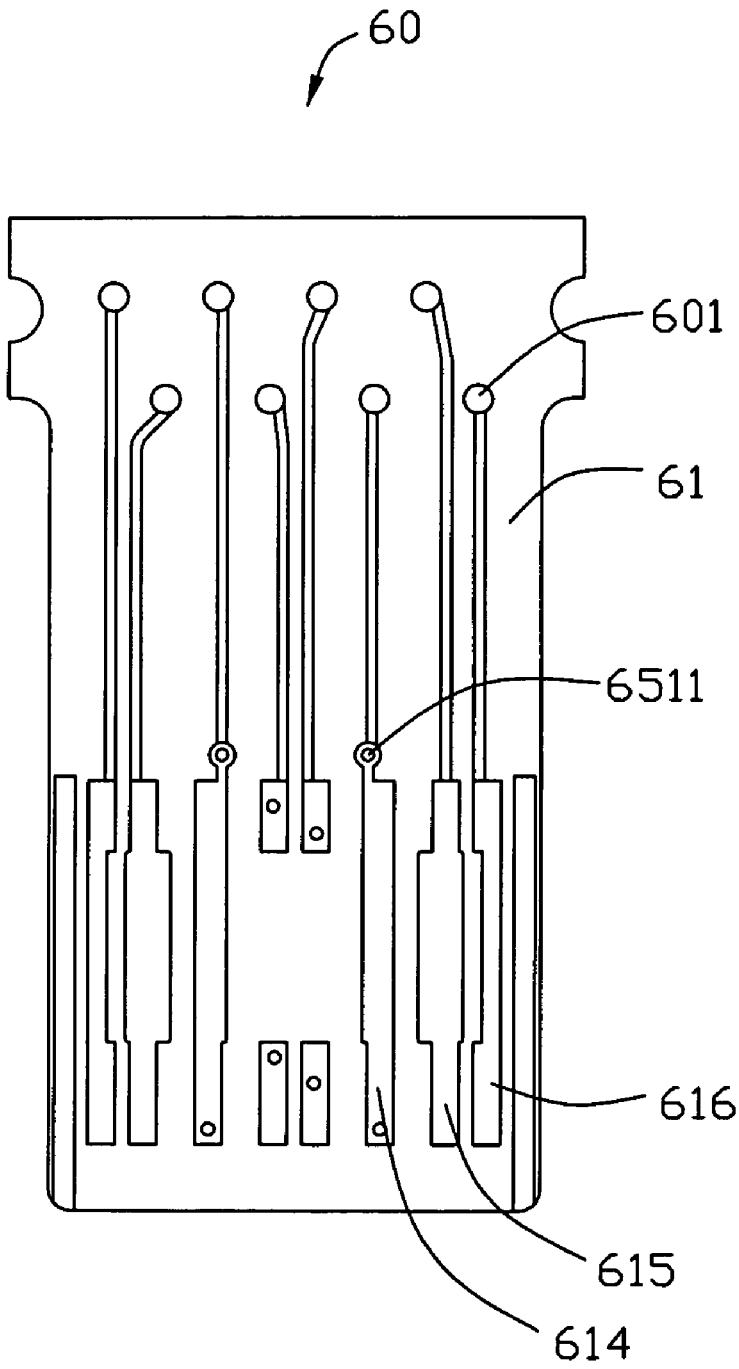
FIG. 7 is a top view of the substrate, with the terminals being removed, showing the first face of the substrate.
Figure 8:
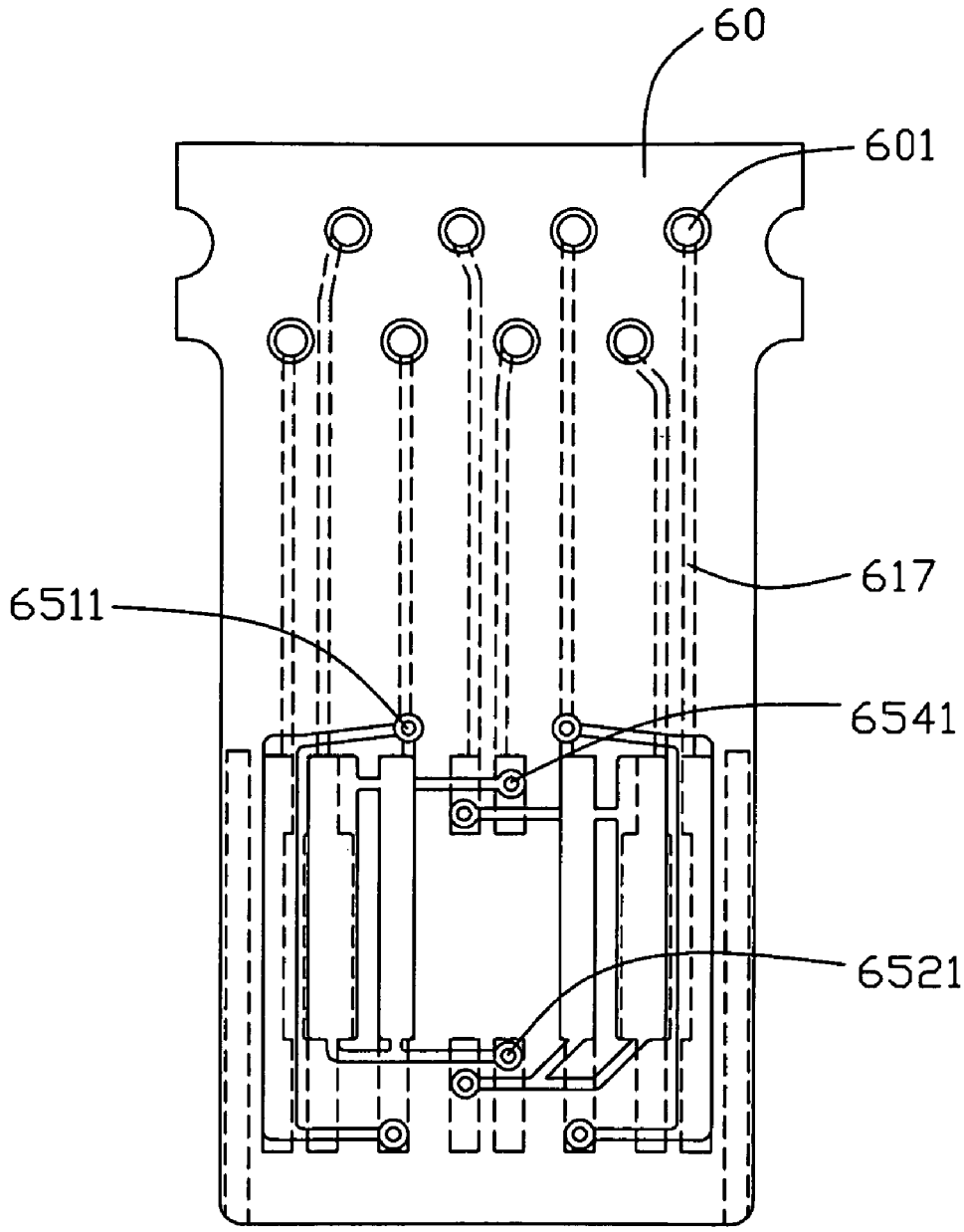
FIG. 8 is a bottom perspective view similar to FIG. 6, but showing the visible second face and the invisible first face of the substrate.

Referring to FIGS. 6-8, the first conductive trace 621 is aligned with the fourth conductive trace 614. The third terminal 83 in contact with the fourth conductive trace 614 is aligned with both the first and the fourth conductive traces 621, 614. The fifth terminal 85 is electrically connected to the first conductive trace 621, through connection portions 652 and 654, to thereby establish an electrical coupling between the pair of third and sixth terminals 83, 86 and the pair of fourth and fifth terminals 84, 85. An electrical influence to the pair of third and sixth terminals 83, 86 created by the pair of fourth and fifth terminals 84, 85 could be better balanced to improve anti-crosstalk performance.

Correspondingly, the second conductive trace 622 is aligned with the fifth conductive trace 615. The second terminal 82 in contact with the fifth conductive trace 615 is aligned with both the second and the fifth conductive traces 622, 615. The fifth terminal 85 is electrically connected to the second conductive trace 622 through connection portions 652, 654 to thereby establish an electrical coupling between the pair of first, second terminals 81, 82 and the pair of fourth, fifth terminals 84, 85. An electrical influence to the pair of first, second terminals 81, 82 created by the pair of fourth, fifth terminals 84, 85 can be better balanced to improve anti-crosstalk performance.

Correspondingly, the third conductive trace 623 is aligned with the sixth conductive trace 616. The first terminal 81 in contact with the sixth conductive trace 616 is aligned with both the third and the sixth conductive traces 623, 616. The third terminal 83 is electrically connected to the third conductive trace 623, through the via 6511, to thereby establish an electrical coupling between the pair of first, second terminals 81, 82 and the pair of third, sixth terminals 83, 86. An electrical influence to the pair of first and second terminals 81, 82 created by the pair of third, sixth terminals 83, 86 can be better balanced to improve anti-crosstalk performance.

A series of tests testing two samples of the electrical connector 100 have been carried out. A plurality of important test parameters acquired from the tests are shown as below.

| terminal | | | The first connector Port (unit: dB) | | | | The second connector Port (unit: dB) | | | |
|---|---|---|---|---|---|---|---|---|---|---|
| Position | pair | Frequency | 1 | 2 | 3 | 4 | 1 | 2 | 3 | 4 |
| Lower Four ports | J12-36 | 1 MHz | −85.2 | −92.67 | −84.85 | −85.01 | −80.38 | −90.16 | −83.64 | −87.06 |
| | | 100 MHz | −49.43 | −49.13 | −52.00 | −50.24 | −50.86 | −51.82 | −50.82 | −52.28 |
| | J36-45 | 1 MHz | −81.44 | −88.2 | −79.87 | −89.42 | −85.75 | −84.85 | −84.74 | −80.02 |
| | | 100 MHz | −43.47 | −43.56 | −43.74 | −43.95 | −43.47 | −43.96 | −43.63 | −44.02 |
| | J45-78 | 1 MHz | −86.74 | −84.84 | −86.52 | −85.95 | −84.11 | −81.23 | −82.49 | −90.04 |
| | | 100 MHz | −47.41 | −48.16 | −47.26 | −47.46 | −46.59 | −47.09 | −46.18 | −48.16 |

"J36-45" denotes a terminal group including the pair of third, sixth terminals 83, 86, and the pair of fourth, fifth terminals 84, 85. Cross-talk loss among any pair of the terminals is no more than −78 dB at 1 MHz, and is no more than −43 dB at 100 MHz. The electrical connector 100 satisfies the performance requirement of Category 5 components.

However, the disclosure is illustrative only, changes may be made in detail, especially in matter of shape, size, and arrangement of parts within the principles of the invention.

What is claimed is:

1. An electrical connector, comprising:

an insulative housing; and a plurality of terminal groups mounted in the insulative housing, each terminal group comprising a substrate having a first face and an opposite second face, and a plurality of terminals each having a contact portion and a body portion attached to the first face of the substrate;

wherein said second face of the substrate is formed with a first conductive trace and a second conductive trace extending in parallel fashion and interconnected together for further electrically connecting with a specific terminal of the plurality of terminals;

wherein said first face has a fourth conductive trace electrically connecting with a selected terminal of the plurality of terminals and aligned with the first conductive trace;

wherein said first face has a fifth conductive trace electrically connecting with a definite terminal of the plurality of terminals and aligned with the second conductive trace;

wherein said first and second conductive traces are provided with a common second connection portion connecting with one end thereof and a common third connection portion connecting with another end thereof.

2. The electrical connector as claimed in claim 1, wherein said second conductive trace has an area larger than that of the first conductive trace.

3. The electrical connector as claimed in claim 1, wherein said fifth conductive trace has an area larger than that of the fourth conductive trace.

4. The electrical connector as claimed in claim 1, wherein each of said conductive traces respectively has a substantially rectangular configuration parallel to an extending direction of the body portions of the terminals.

5. The electrical connector as claimed in claim 1, wherein said insulative housing comprises eight ports symmetrically arranged in two upper and lower rows.

6. The electrical connector as claimed in claim 1, wherein said first face of the substrate is provided with a plurality of soldering holes and a plurality of lead portions, and wherein the terminals are connected to the soldering holes through the lead portions.

7. The electrical connector as claimed in claim 1, further comprising a shielding shell attached to an outer surface of the insulative housing.

8. The electrical connector as claimed in claim 1, wherein said second and third connection portions extend inwardly for connecting with the specific terminal.

9. The electrical connector as claimed in claim 8, wherein said second and the third connection portions respectively have a second and a third connection vias extending through the substrate from the second face to the first face for connecting with the specific terminal.

10. The electrical connector as claimed in claim 1, wherein said terminals comprise first through eighth terminals substantially parallel to each other and being arranged on the first face in sequence, and wherein the definite terminal, the selected terminal, and the specific terminal are respectively defined as the second, the third, and the fifth terminals.

11. The electrical connector as claimed in claim 10, wherein said first face of the substrate has a sixth conductive trace electrically connecting with the first terminal, and said second face of the substrate has a third conductive trace aligned with the sixth conductive trace.

12. The electrical connector as claimed in claim 11, wherein said sixth conductive trace has an area larger than that of the fourth conductive trace, and smaller than that of the fifth conductive trace.

13. The electrical connector as claimed in claim 11, wherein said third conductive trace has an area larger than that of the first conductive trace, and smaller than that of the second conductive trace.

14. The electrical connector as claimed in claim 11, wherein said third conductive trace has a pair of first connection portions formed at opposite ends thereof for connecting with the third terminal.

15. The electrical connector as claimed in claim 14, wherein said first connection portion is provided with a first connection via extending through the substrate from the second face to the first face for electrically connecting the third conductive trace to the fourth conductive trace and therefore to the third terminal.

* * * * *